United States Patent [19]

Smejkal et al.

[11] 4,077,616

[45] Mar. 7, 1978

[54] METALLURGICAL VESSEL LINING ARRANGEMENT

[75] Inventors: Hellmuth Smejkal; Otto Hiris, both of Linz; Helmut Mayrandl, Steyr, all of Austria

[73] Assignee: Vereinigte Osterreichische Eisen- und Stahlwerke-Alpine Montan Aktiengesellschaft, Linz, Austria

[21] Appl. No.: 694,154

[22] Filed: Jun. 7, 1976

[30] Foreign Application Priority Data

Jun. 10, 1975 Austria ..... 4392/75

[51] Int. Cl.[2] ..... C21C 5/42

[52] U.S. Cl. ..... 266/281

[58] Field of Search ..... 266/243, 245, 280, 281, 266/287; 187/24; 254/92, 102; 182/128, 141, 148

[56] References Cited

U.S. PATENT DOCUMENTS

| | | | |
|---|---|---|---|
| 495,205 | 4/1893 | Reinau | 187/24 |
| 3,314,655 | 4/1967 | Steele | 254/102 |
| 3,517,771 | 6/1970 | Mahringer et al. | 182/128 |
| 3,752,261 | 8/1973 | Bushnell | 182/141 |
| 3,851,854 | 12/1974 | Roybal | 182/141 |

FOREIGN PATENT DOCUMENTS

| | | | |
|---|---|---|---|
| 1,544,984 | 9/1968 | France | 266/281 |

*Primary Examiner*—Gerald A. Dost
*Attorney, Agent, or Firm*—Brumbaugh, Graves, Donohue & Raymond

[57] ABSTRACT

A lining arrangement for metallurgical vessels has a frame, a lifting scaffold arranged thereon comprised of at least two tube elements composed of tube pieces, and a working platform arranged on top of the lifting scaffold. The tube pieces are telescopically movable into one another.

6 Claims, 3 Drawing Figures

METALLURGICAL VESSEL LINING ARRANGEMENT

BACKGROUND OF THE INVENTION

The invention relates to a lining arrangement for metallurgical vessels, in particular converters, having a lifting scaffold formed by two or more tube elements and carrying a working platform.

For lining a converter or crucible, a height-adjustable working platform is used, which platform is moved into the upright converter from below, after its bottom has been removed. Since the diameter of the converter bottom opening in most cases is substantially smaller than that of the converter interior, the working platform suitably is enlargeable in the interior of the converter by means of segments. In such a lining arrangement usually a central elevator is provided with which the necessary lining material can be lifted to the working platform. Since it is desirable to avoid loads suspended above the working platform, it is necessary to provide room, in the relatively narrow bottom opening of the converter, for the elevator platform adjacent the supporting scaffold of the working platform.

Lining arrangements have been known whose scaffold consists of telescopically extendable and retractable tube elements which are height-adjustable by means of moving elements, such as pinion and toothed rack. In this kind of lining arrangement, however, the working platform is difficult to reach, since the scaffold, which tapers in steps in the upward direction, has only a small space for the elevator platform, particularly with scaffolds having more than two tube elements. Furthermore, it is necessary for the lining material to be precisely centered before it is delivered up into the vessel so that it does not hit the parts of the scaffold limiting the inner space of the scaffold and tapering in steps, thereby causing displacement or damage to parts of the scaffold.

Furthermore, lining arrangements are known whose scaffold is formed by tube elements of equal diameters which are attached to one another — depending on the elevated position of the working platform required — by flange-like connection means. In these lining arrangements the working platform is more readily accessible. These arrangements are complicated, however, since tube elements have to be brought to the scaffold and connected thereto, or removed, respectively, in order to change the height of the working platform.

SUMMARY OF THE INVENTION

The invention aims at preventing these disadvantages and difficulties and has as its object to provide a lining arrangement whose working platform is easily displaceable from its lowest to its top position without requiring the installation or removal of scaffold parts and whose scaffold inner space has substantially the same diameter from the lowest to the highest tube element with as large a space as possible being provided for the elevator platform.

According to the invention this object is achieved in a lining arrangement of the above defined kind in that the tube elements are each assembled of vertical peripherally arranged tube pieces. The upper or lower ends of the tube pieces are each connected with a frame and the tube pieces are telescopically movable into one another.

Advantageously, the tube pieces are designed as screw spindle columns which are screwable into and out of one another.

Suitably, the screw spindle columns can be screwed into and out of one another by means of pinions secured to their periphery and driven by a common ring gear, whereby a completely uniform (synchronous) movement of the screw spindle columns is achieved and jamming of the tube elements is prevented, even when the working platform is eccentrically loaded.

A preferred embodiment of the invention is characterized in that the screw spindle columns of the middle tube element of a scaffold comprised of three tube elements, are drivable and are designed as nut spindles engaging the corresponding screw spindle columns of the other tube elements. The screw spindle columns of the other tube elements are rigidly secured in their frames. This embodiment has the advantage that only the screw spindle columns of one of the three tube elements need be driven.

Advantageously, the screw spindle columns of the middle tube element have the widest diameter and can be screwed over the screw spindle columns of the lowest tube element, and the screw spindle columns of the uppermost tube element can be submerged into those of the lowest tube element.

According to a further feature of the invention at least one vertical guide rod is arranged on each tube element for an elevator means, which vertical guide rods are staggered relative to one another in horizontal direction so that they are located one beside the other when the tube pieces are moved into one another.

BRIEF DESCRIPTION OF THE DRAWINGS

The invention shall now be described, by way of example only, with reference to the accompanying drawings, wherein.

DESCRIPTION OF AN EXEMPLARY EMBODIMENT

Figure 1:
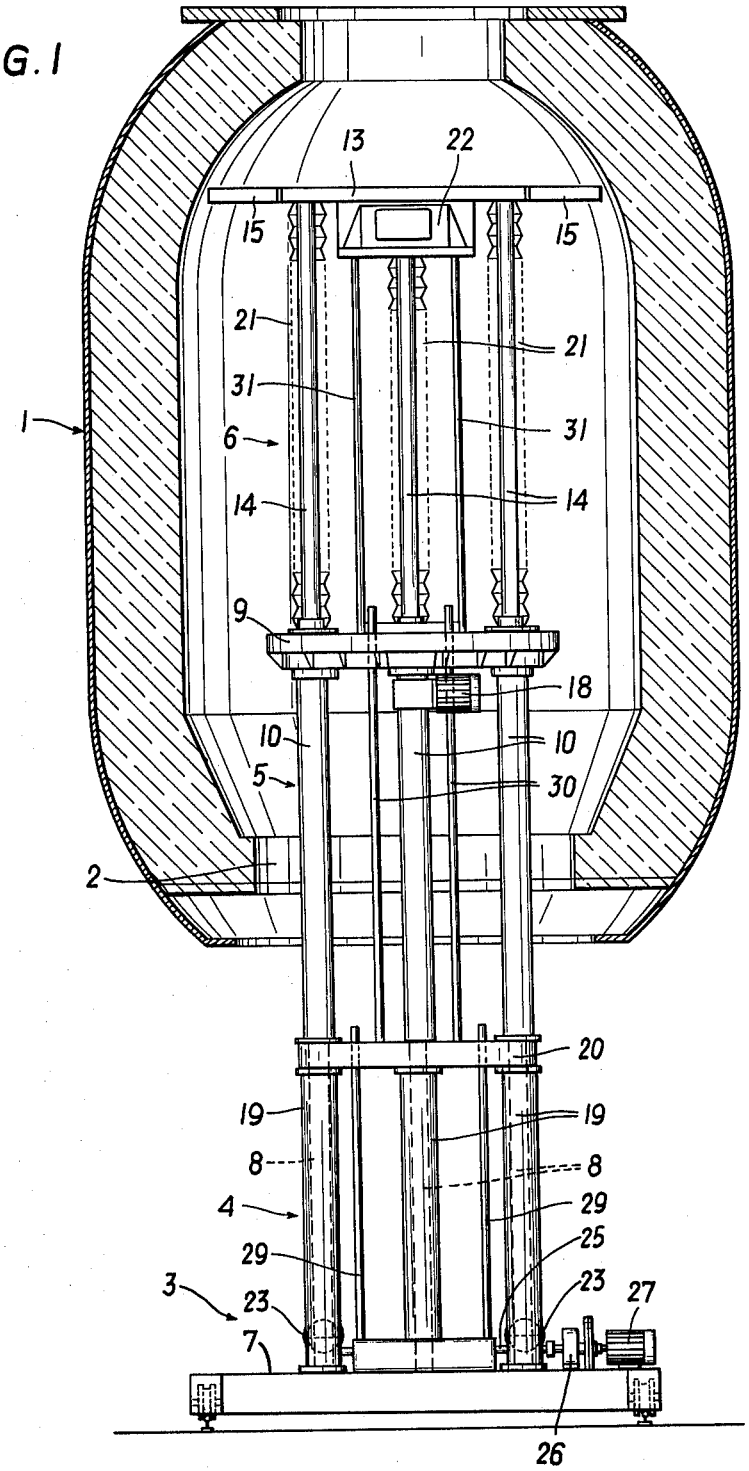
FIG. 1 is a front view of the lining arrangement introduced from below into a converter shown in section.
Figure 3:
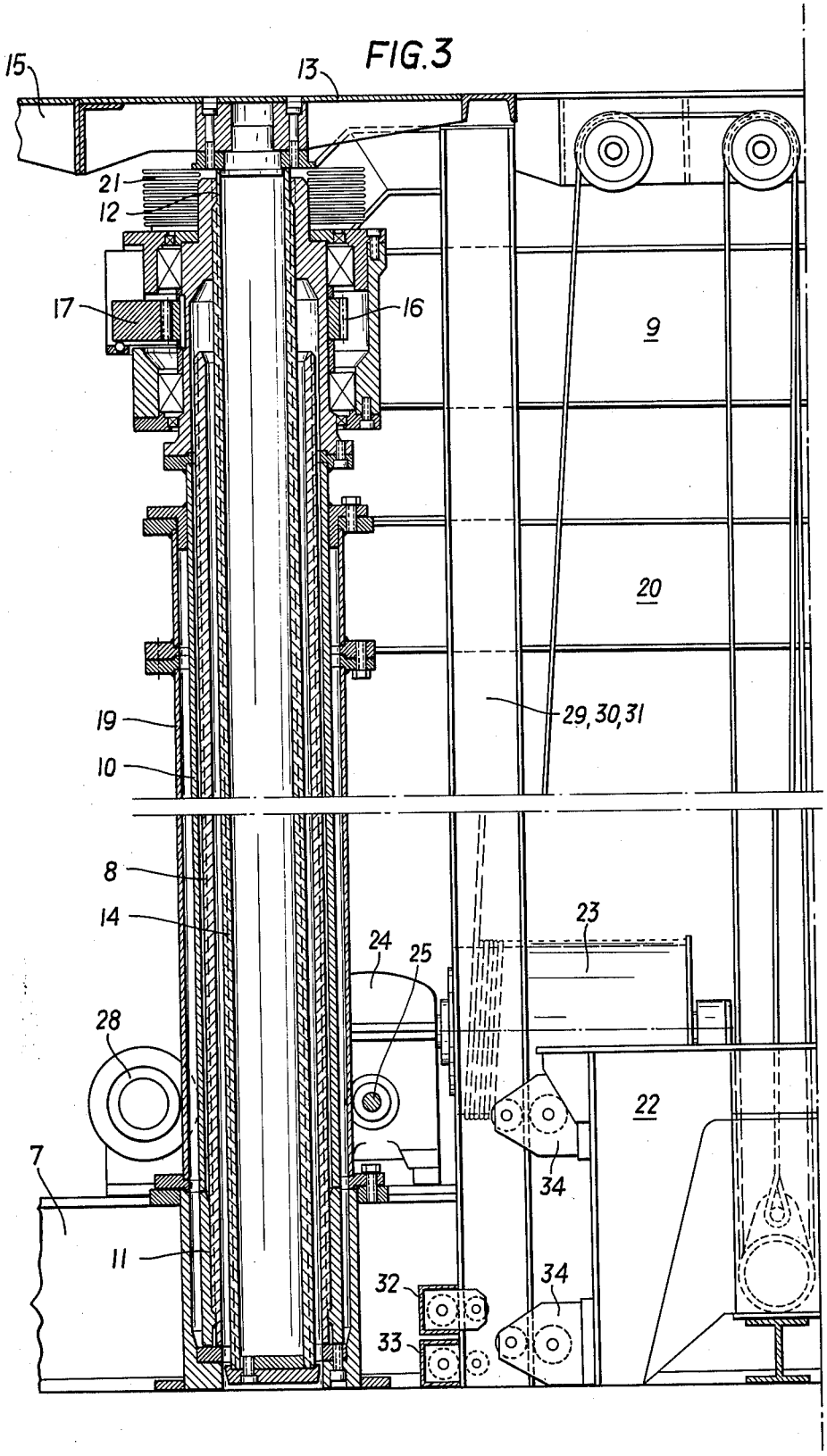
FIG. 3 is a section along the axis of a screw spindle column through the lining arrangement, the working platform being in its lowest position.

In FIG. 1 a converter is denoted with 1, which converter has a bottom opening 2. Below a bottom opening, the lining arrangement 3, which is movable on wheels, is positioned. A lifting scaffold of the lining arrangement is comprised, of three tube elements 4, 5 and 6. On a traveling frame 7 of the lining arrangement, three hollow screw spindle columns 8 are mounted, forming the lowest tube element 4. The middle one of the three tube elements, tube element 5, is formed by the hollow nut spindles 10, the upper ends of which are rotatably mounted in a frame 9. These nut spindles are provided with inside threads at both of their ends. The inside threads 11 (FIG. 3) provided on the lower ends engage the screw spindle columns 8 and the inside threads 12 provided on the upper ends, which have opposite ascent being connected with the screw spindle columns 14. The screw spindle columns 14 are rigidly connected to the annular working platform 13 and form the uppermost tube element 6. The outer dimensions of the working platform can be adapted to the contour of the vessel to be lined by means of enlargement segments 15 to be hung on the outer periphery of the working platform 13 and locked. The drive of the nut spindles 10 is effected by pinions 16 peripherally secured at their upper ends and jointly driven by a common ring gear 17. The ring gear 17 is mounted in frame 9 and can be driven by a gear braking motor 18 arranged on the frame 9. As can be seen, rotation of the nut spindles 10, depending on the direction of rotation, causes an upward or downward movement of the working platform. The exterior diameter of the screw spindle columns 14 is so dimensioned that the screw spindle columns 14 can be submerged in the inner space of the hollow screw spindle columns 8 when the working platform is lowered. The threads of all the screw spindle columns have an ascent that is smaller than the pertaining angle of friction so that the threads act self-inhibitingly, and thus the working platform is absolutely secured against falling down. For protecting the threads the screw spindle columns 8 are arranged in tube columns 19. The interior diameter of the tube columns 19 is somewhat wider than the exterior diameter of the nut spindles 10, so that the nut spindles are also surrounded by the tube columns 19 when the working platform 13 is lowered. The tube columns 19, with their upper ends, carry a guide frame 20 that serves for supporting and improved guiding of the nut spindles. The threads of the screw spindle columns 14 are protected by bellows-type members 21.

Figure 2:
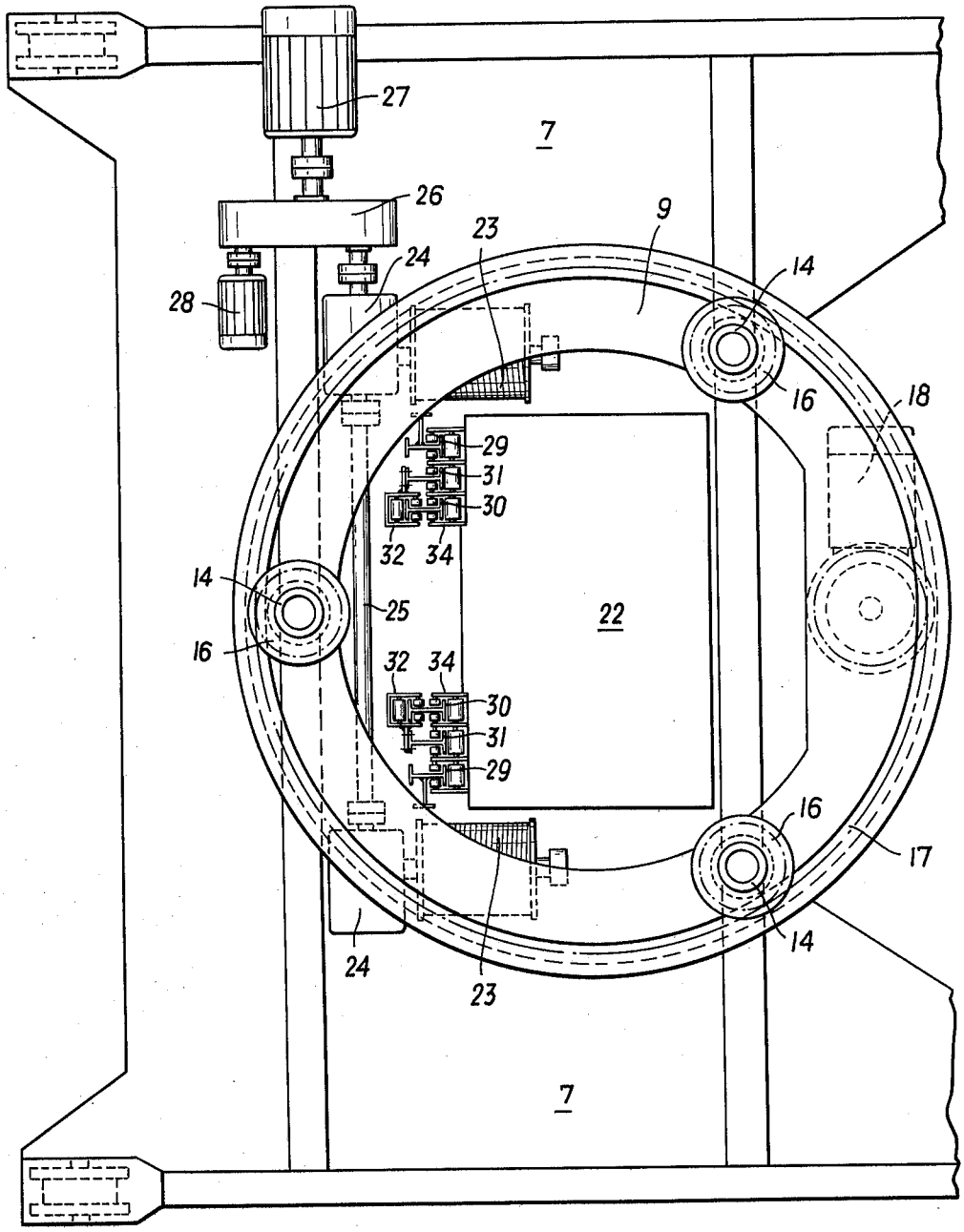
FIG. 2 is a top view onto the lifting scaffold without the working platform.

The working platform 13 is provided with a bottom opening at its center, into which bottom opening an elevator platform 22 for transporting the lining material can be moved. Two elevator ropes, which are deflected three times and are arranged at opposite sides of the elevator platform, are used as the drive for lifting and lowering the elevator platform. One of the ends of each rope is fixed on rope reels 23 and the other ends are fixed on the elevator platform 22 itself. The rope reels 23 are coupled with worm gears 24 connected by a shaft 25. This arrangement allows for an absolutely synchronous movement of the two rope reels. The worm gears, via a spur gearing 26 having a built-in electromagnetic coupling, are selectively driven by an electromotor 27 for rapid movement or by an electromotor 28 having a built-in brake for slow movement of the platform 22. The motor 28 furthermore has the task of turning the rope reels in the respective direction, during the lifting and lowering of the working platform 13, at such a speed that the elevator platform 22, which is in its lowest position (loading position) is not moved or that the rope does not slacken. The working platform for safety reasons may only be moved when the elevator platform is in its lowest position. This is guaranteed by an electric bolting of the drive motors 18 and 27 or 18 and 28, respectively. Each one of the tube elements 4, 5 and 6 is provided with a vertically arranged pair of guide rods (29, 30 and 31), having an I-cross-section. For the elevator platform 22, the guide rods 29 are mounted with their upper ends on the guide frame 20 and with their lower ends on the travelling frame 7. The guide rods 30 are on the frame 9 with the guide rods 31 on the working platform 13. The guide rods are staggered relative to one another in the horizontal direction so that they are placed one beside the other when the screw spindle columns are screwed into one another (FIG. 2). The lower ends of the guide rods 30 and 31 are each connected, by means of roller carrying transverse yokes 32 and 33, with the guide rods associated to the lower tube element, whereby the guide rods can be guided along one another when the height of the working platform 13 is changed. The elevator platform 22 is guided on the guide rods 29, 30 and 31 by means of roller brackets 34, a separate pair of rollers being provided for each guide rod so that at least one pair of guide rods is always in engagement with the associated pairs of rollers.

What we claim is:

1. A liftable and lowerable arrangement for lining metallurgical vessels, in particular converters, including a first upper tube element;

a second lower tube element; and a third middle tube element between the first and second tube elements, each tube element comprising a frame member and at least three vertical tube pieces located at the periphery of the tube element, the frame member of said first element being a working platform of the arrangement, the upper end of each vertical tube piece being connected with its respective frame member, the tube pieces of the first and second tube elements being telescopically movable into the tube pieces of the third tube element.

2. An arrangement as set forth in claim 1, wherein the tube pieces are designed as screw spindle columns, the screw spindle columns of the first and second tube element being screwable into and out of the screw spindle columns of the third tube element.

3. An arrangement as set forth in claim 1, wherein the tube pieces are designed as screw spindle columns, and wherein, for at least one of the tube elements, pinions are provided, which pinnirons are pinnions to the periphery of the respective screw spindle columns and wherein a ring gear is provided for commonly driving the pinions to screw the screw spindle columns of the first and second tube elements into and out of the screw spindle columns of the third tube element.

4. A liftable and lowerable arrangement for lining metallurgical vessels, in particular converters, including:

a first upper tube element;

a second lower tube element;

a third middle tube element between the first and second tube elements, each tube element comprising a frame member and at least three vertical tube pieces located at the periphery of the tube element, the frame member of said first element being a working platform of the arrangement, the upper end of each vertical tube piece being connected with its respective frame member, the tube pieces of the first and second tube elements being telescopically movable into the tube pieces of the third tube element;

at least one vertical guide rod arranged on each tube element; and an elevator means guided by the vertical guide rods, the guide rods being staggered in the horizontal direction relative to one another so as to be placed beside one another when the tube pieces of the first and second tube elements are moved into the tube pieces of the third tube element.

5. A liftable and lowerable arrangement for lining metallurgical vessels, in particular converters, including:

an upper tube element including a working platform;

a lower tube element; and a middle tube element therebetween, each tube element comprising a frame member connected to the top of at least three vertical screw spindle columns located at the periphery of the tube element, the working platform being the frame member of said upper tube element, the screw spindle columns of the middle tube element being nut spindles in screwable engagement with the respective screw spindle columns of the upper and lower tube elements, pinions being peripherally secured to the nut spindles and a ring gear being provided for commonly driving the pinions, the screw spindle columns of the upper and lower tube elements being rigidly secured in their respective frame members.

6. An arrangement as set forth in claim 5, wherein the nut spindles of the middle tube element have diameters large enough to be screwable over the screw spindle columns of the lower tube element and the screw spindle columns of the upper tube element are small enough to be received in the screw spindle columns of the lower tube element.

* * * * *

UNITED STATES PATENT OFFICE

CERTIFICATE OF CORRECTION

Patent No. 4,077,616 Dated Mar. 7, 1978

Inventor(s) Smejkal et al.

It is certified that error appears in the above-identified patent and that said Letters Patent are hereby corrected as shown below:

Col. 2, line 30, after "in" insert --the--;

Col. 2, line 52, after "comprised" delete the comma;

Col. 3, lines 51 & 52, "electric bolting" should read --electrical coupling--;

Col. 4, lines 24 & 25, "element" should read --elements--; and

Col. 4, line 30, "pinnirons are pinnions" should read --pinions are secured--.

Signed and Sealed this

*Eighteenth* Day of *July 1978*

[SEAL]

*Attest:*

RUTH C. MASON
*Attesting Officer*

DONALD W. BANNER
*Commissioner of Patents and Trademarks*